US007520414B2

(12) United States Patent
Blessing et al.

(10) Patent No.: US 7,520,414 B2
(45) Date of Patent: Apr. 21, 2009

(54) HAND-HELD DRIVE-IN TOOL

(75) Inventors: Matthias Blessing, Frastanz (AT); Hans Gschwend, Buchs (CH); Ulrich Schiestl, Feldkirch (AT); Robert Spasov, Schaan (LI)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 12/001,256

(22) Filed: Dec. 10, 2007

(65) Prior Publication Data

US 2008/0210736 A1 Sep. 4, 2008

(30) Foreign Application Priority Data

Dec. 12, 2006 (DE) ..... 10 2006 000 517

(51) Int. Cl.
*B65C 1/06* (2006.01)

(52) U.S. Cl. ..... 227/131; 227/2; 227/132; 173/117

(58) Field of Classification Search ..... 227/131, 227/132, 2, 130; 173/117, 124, 205
See application file for complete search history.

(56) References Cited

U.S. PATENT DOCUMENTS 3,305,156 A * 2/1967 Khan ..... 227/132
3,589,588 A * 6/1971 Vasku ..... 227/132
3,810,572 A * 5/1974 Malkin ..... 227/132
3,924,789 A * 12/1975 Avery et al. ..... 227/131
4,323,127 A * 4/1982 Cunningham ..... 173/53
4,946,087 A * 8/1990 Wingert ..... 227/131
5,098,004 A * 3/1992 Kerrigan ..... 227/134
5,511,715 A * 4/1996 Crutcher et al. ..... 227/131
6,604,666 B1 * 8/2003 Pedicini et al. ..... 227/131
6,796,477 B2 * 9/2004 Chen ..... 227/2
6,857,549 B1 * 2/2005 Chen ..... 227/131
7,165,305 B2 * 1/2007 Kenney et al. ..... 29/434

* cited by examiner

*Primary Examiner*—Scott A. Smith
(74) *Attorney, Agent, or Firm*—Abelman, Frayne & Schwab

(57) ABSTRACT

A hand-held drive-in tool for driving fastening elements (60) in a workpiece (U) includes a drive-in ram (13) displaceable in a guide (12), a spring (31) for driving the drive-in ram (13), a tensioning device (70) for loading the driving spring (31), a locking device (50) for retaining, in its locking position (54), the driving spring (31) in its loaded position thereof (33), and a sliding nut (78) supported on a threaded spindle (76), which is rotatable by the motor (71) of the tensioning device (70), without a possibility of rotation thereabout but with a possibility of an axial displacement therealong, the sliding nut (78) being axially displaceable, upon actuation of the motor (71) of the tensioning device (70) by a control unit (23) of the drive-in tool (10), from the first end position (83) to the second end position (84) for displacing the driving spring (31) into the loading position (33) of the driving spring (33), and being subsequently displaceable from its second end position (84) into the first end position (83) to provide for displacement of the driving spring (31) to its release position.

6 Claims, 4 Drawing Sheets

HAND-HELD DRIVE-IN TOOL

BACKGROUND OF THE INVENTION

1. Field of the Invention

The present invention relates to a hand-held drive-in tool for driving fastening elements in a workpiece and including a housing, a guide located in the housing, a drive-in ram displaceable in the guide for driving in a fastening element, a spring for driving the drive-in ram, a tensioning device for loading the driving spring and including a motor and a threaded spindle rotatable by the motor, a locking device for retaining, in its locking position, the driving spring in its loaded position, and an actuation switch for displacing the locking device from the locking position of the locking device to a release position of the locking device in which the driving spring is displaced from its loaded position to its release position for driving the drive-in ram.

2. Description of the Prior Art

Drive-in tools of the type discussed above can be driven, e.g., electrically, with a driving spring serving as an energy accumulator for the drive-in ram. The driving spring is loaded or tensioned by a tensioning mechanism. The advantage of such drive-in tools consists in their simple and easy-to-produce construction.

A drive-in tool, which is formed as an electric nailer, is disclosed in U.S. Pat. No. 3,810,572. The disclosed drive-in tool has a drive-in ram the end of which remote with respect to a drive-in direction, is formed as a spindle-shaped threaded section. A radially outer sleeve, which surrounds the drive-in ram, is rotated by a drive motor, whereby balls, which are displaceable within the sleeve, engage the thread of the threaded section of the drive-in ram to displace the drive-in ram against the driving spring. For initiating a drive-in process, there is provided a stop sleeve that is displaceable over the outer sleeve and that is displaced axially upon actuation of a trigger in order to displace the locking balls radially outwardly in their release position. Another stop sleeve, which is displaceable over the first stop sleeve, controls the radial release of the thread-engaging balls.

The drawback of the drive-in tool, which is disclosed in U.S. Pat. No. 3,810,572, consists in a very complex arrangement of the three sleeves, which increases the costs of the drive-in tool, on one hand and, on the other hand, upon actuation of the drive-in tool, the entire force of the driving spring is applied, in a short time, to a very small surface on the edge of the thread where the last locking ball has been released. This leads to a danger of the thread edge being chipped.

A drive-in tool of the type discussed above and which is formed as an electric tacker, is disclosed in German Publication DE 32 37 087 A1. In the disclosed drive-in tool, a drive-in ram, which is formed as a striker, is driven by a rotatable motor against a driving spring in a loaded position. To this end, on the drive-in ram, there is provided toothing engageable with a threaded spindle driven by the electric motor. In its loaded position, the driving spring pivots the threaded spindle out of its engagement with the toothing on the drive-in ram. The drive-in ram is retained in the loaded position by a locking member. In order to initiate a drive-in process, an actuation switch such as an actuation lever or push-button is actuated in response to which the locking member is released from its locking position with the drive-in ram. The fastening elements which a driven-in with an electric tacker, can be stored, e.g., in a magazine.

The drawback of the drive-in tool of DE 32 37 087 consists in that a construction with a controlled, pivotal-out spindle is rather expensive. Moreover, the pivotal-out spindle is two large and expensive, which is a big drawback in hand-held drive-in tools.

Accordingly, an object of the present invention is to provide a drive-in tool of the type discussed above in which the drawbacks of the prior art drive-in tool are eliminated.

SUMMARY OF THE INVENTION

This and other objects of the present invention, which will become apparent hereinafter, are achieved by providing in a drive-in tool of the type discussed above, a sliding nut supported on the threaded spindle without a possibility of rotation thereabout but with a possibility of an axial displacement therealong, with the sliding nut being axially displaceable, upon actuation of the motor of the tensioning device by a control unit of the drive-in tool, between a first end position and a second end position and being displaceable, during a loading cycle, from the first end position to a second end position for displacing the driving spring into the loading position of the driving spring, and being subsequently displaceable from the second end position thereof into the first end position to provide for displacement of the driving spring into its release position. Thereby, the sliding nut is again in its initial position before a drive-in process is initiated, and the path for the driving spring is free. In case, the driving spring is loaded indirectly, via the drive-in ram, when the sliding nut cooperates with the drive-in ram, the drive-in ram can likewise be displaced to its initial position with the displacement of the sliding nut to its initial position. A complicated mechanics for the return displacement of threaded spindle is not any more necessary. Likewise, the problem of a chipped edge of the thread of the threaded spindle is eliminated.

It is advantageous, when the sliding nut is provided with at least one ball that serves as thread engagement means for engaging the threaded spindle. With formation of the sliding nut as a ball nut, the frictional and energy losses, which occur during displacement of the drive-in ram against the driving spring, can be noticeably reduced.

It is further advantageous when a first control conductor connects the locking device with the control unit, and a second control conductor connects the motor of the tensioning device with the control unit. Thereby, it becomes possible, to use the locking device for controlling reversing of the direction of rotation of the motor of the tensioning device in order to effect displacement of the sliding nut to its first, initial end position, e.g., when the pawl of the locking device engages, at the end of the loading movement of the tensioning device, the locking surface on the drive-in ram, generating a control signal. Alternatively, the reversing of the rotational direction of the motor can take place when the motor load reaches a predetermined value, e.g., when the driving spring (and also the drive-in ram, as the case may be) reaches its loaded position.

A technically simple solution of retention of the sliding nut against rotation is achieved by providing a guide element along which the sliding nut can be displaced without a possibility of rotation.

Advantageously, there is provided at least one damping member for braking movement of the drive-in ram in a drive-in direction, which is spaced from a first stop of the drive-in ram, with which the damping member cooperates, by an axial distance that is smaller than an axial distance by which the sliding nut is spaced, in its first end position from a stop of the drive-in ram which is located opposite the sliding nut. Thereby, an impact of the drive-in ram, which is displaceable in the drive-in direction, on the sliding nut that occupies its first end position, at the end of the drive-in process, is prevented. The drive-in ram impacts only the damping member. This increases the service life of the sliding nut.

A compact structure is obtained when the axis of the output shaft of the motor of the tensioning device extends parallel to a rotational axis of the threaded spindle, and the motor is located between planes defined, respectively, by end surfaces of the threaded spindle.

The novel features of the present invention which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
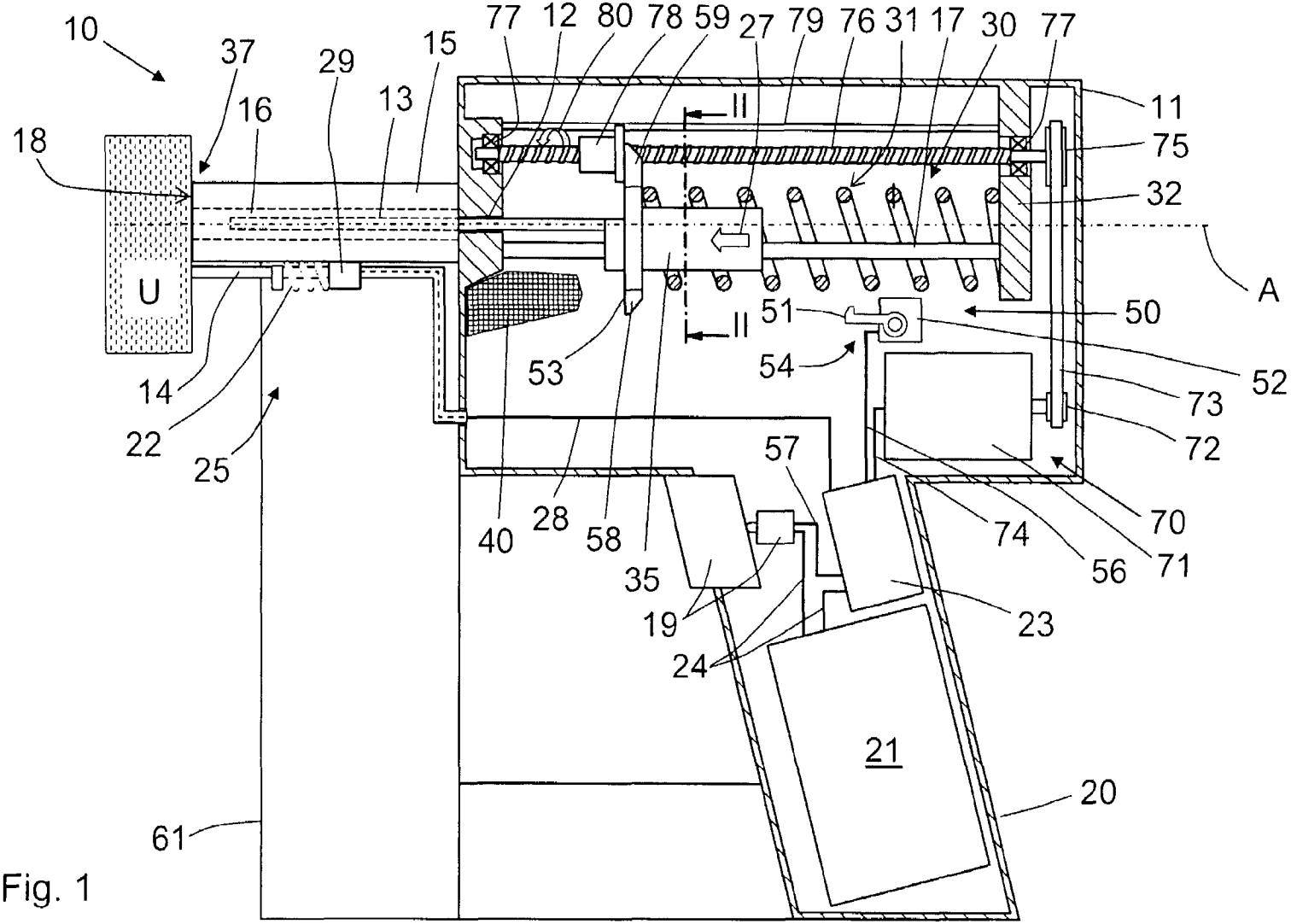
FIG. 1 a cross-sectional side view of a drive-in tool according to the present invention in a pressed-against-workpiece, position.
Figure 2:
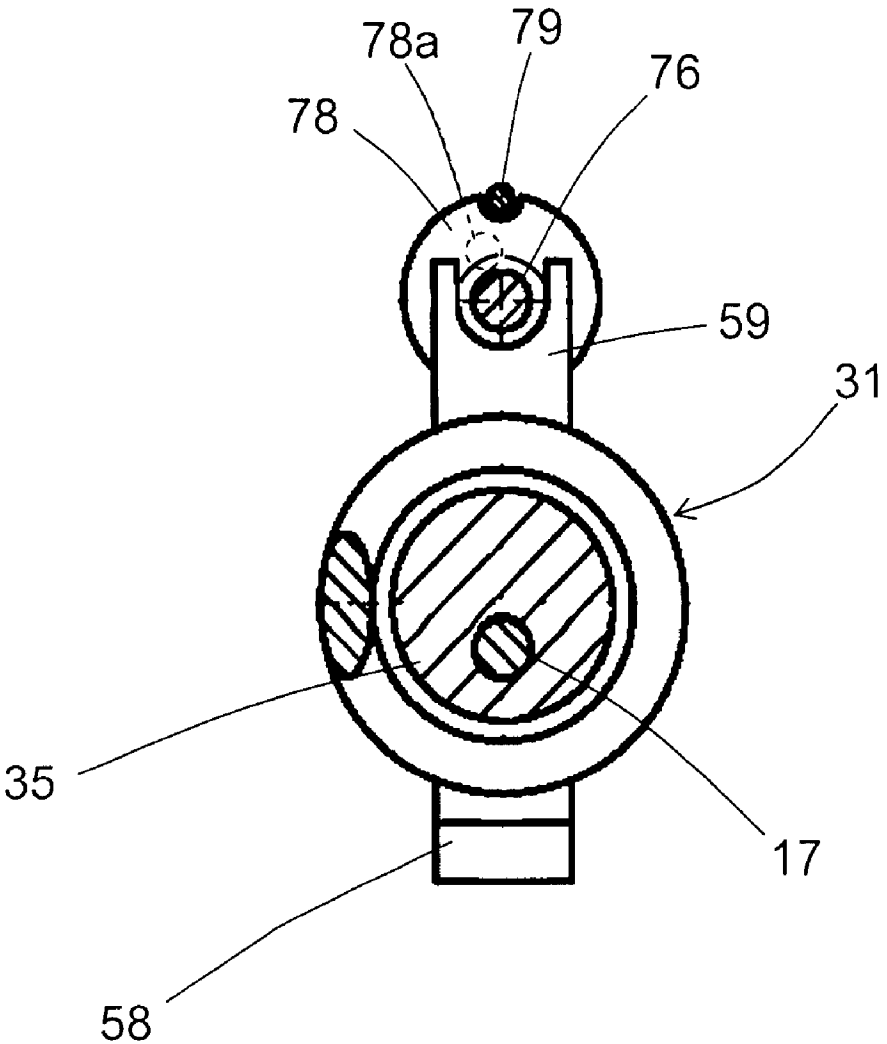
FIG. 2 a cross-sectional view along line II-II in FIG. 1.

A hand-held power drive-in tool 10 according to the present invention, which is shown in FIGS. 1-4, is electrically operated and includes a housing 11 in which a drive for a drive-in ram 13 that generally designated with a reference numeral 30, is located. The drive-in ram 13 is displaceable in a guide 12, likewise located in the housing 11, and has a guide section 35 that is displaceable along a first guide member 17 (see in particular FIG. 2). The drive 30 includes a driving spring 31 that is supported with one of its opposite ends against the housing 11 at a stop surface 32, and is supported with the other of the opposite ends against the drive-in ram 13.

A muzzle part 15 adjoins an end of the guide 12 that faces in the drive-in direction 27. The muzzle part 15 has a drive-in channel 16 for a fastening element 60 and which extends coaxially with the guide 12. Sidewise of the muzzle part 15, there is arranged a magazine 61 for fastening elements in which the fastening elements can be stored.

The drive-in tool 10 further includes a handle 20 on which an actuation switch 19 for actuating a drive-in process with the drive-in tool 10 is located. In the handle 20, there is further located a power source which is generally designated with a reference numeral 21 and which supplies the drive-in tool 10 with an electrical energy. In the embodiment discussed here, the power source 21 contains at least one accumulator. Feed electrical conductors 24 connect the power source 21 with an electrical control unit 23 and with the actuation switch 19. A switch conductor 57 connects the actuation switch 19 with the control unit 23.

Figure 3:
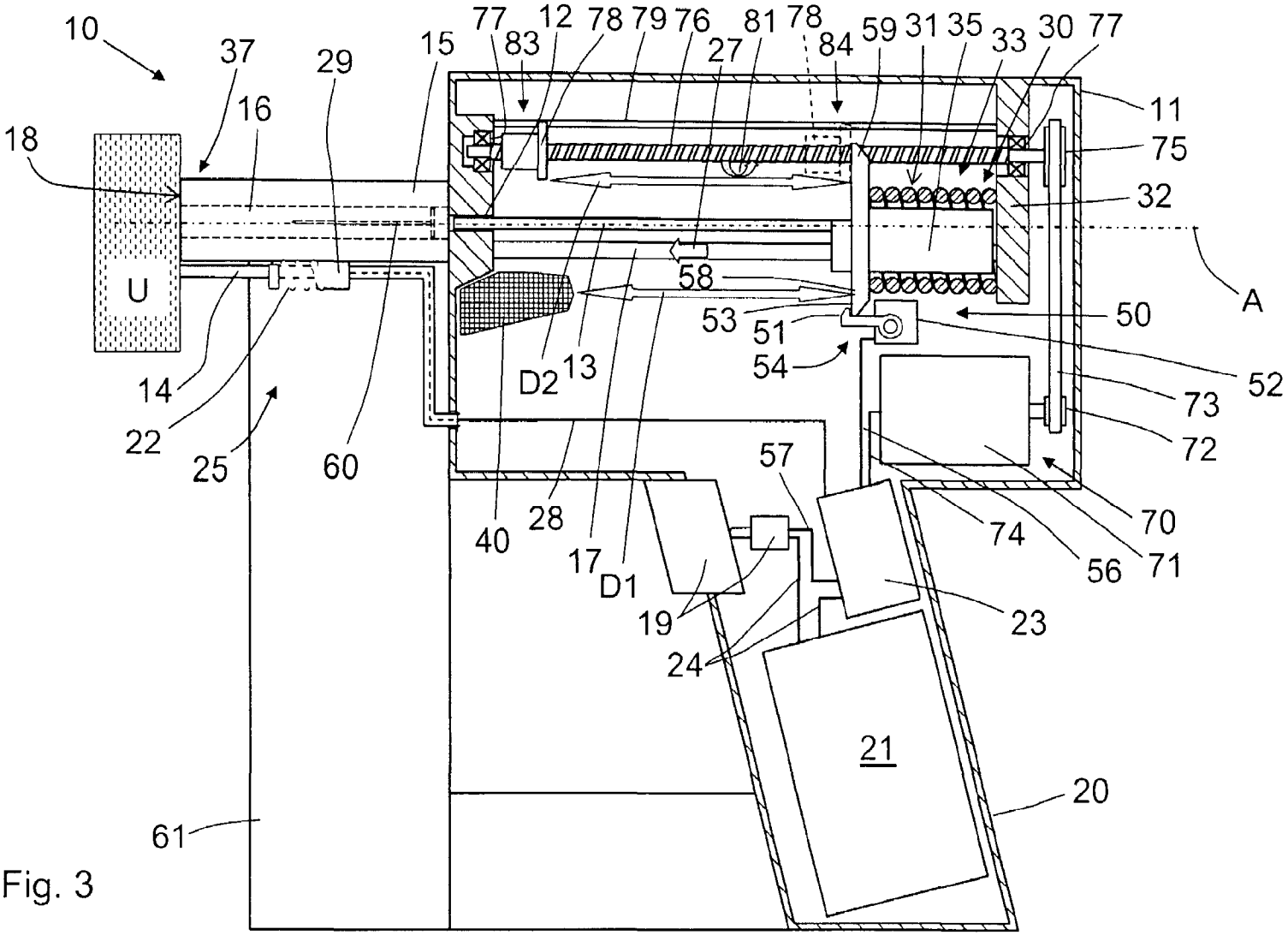
FIG. 3 a cross-sectional side view of the drive-in tool shown in FIG. 1 in a drive-in-ready position.
Figure 4:
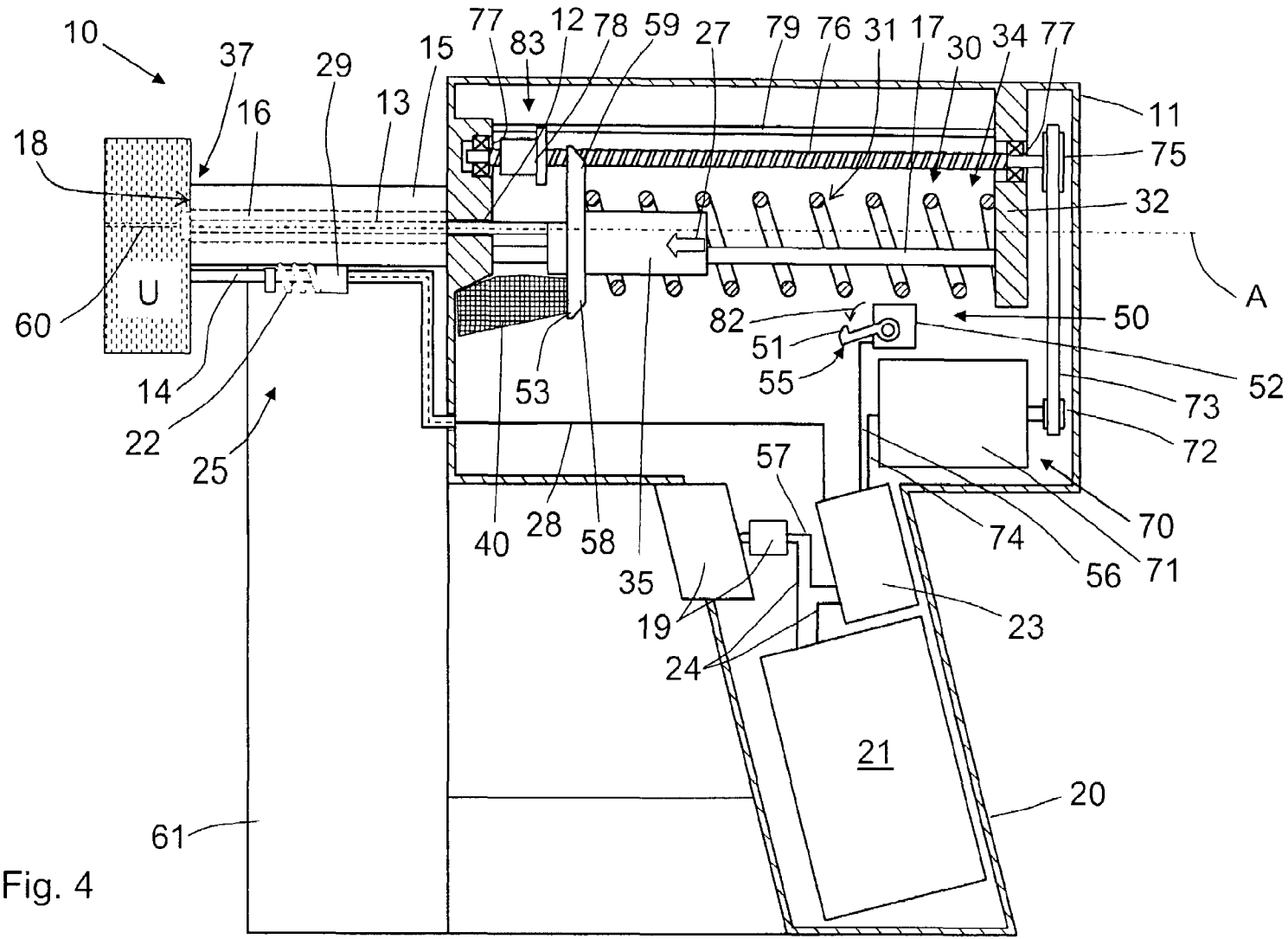
FIG. 4 a cross-sectional view of the drive-in tool shown in FIG. 1 after actuation of a drive-in process.

On the muzzle part 15 of the drive-in tool 10, there is provided a press-on element 14 of a safety device 25 and which is formed as a press-on feeler. The press-on element 14 actuates a press-on switch 29 of the safety device 25. A switching conductor 28 electrically connects the press-on switch 29 with the control unit 23. The press-on switch 29 communicates an electrical signal to the control unit 23 as soon as the drive-in tool 10 is pressed with a muzzle 18 of the muzzle part 15 against a workpiece U, as shown in FIG. 1. The press-on switch 29 insures that the drive-in tool 10 can only then be actuated when it is properly pressed against the workpiece U. To this end, the press-on element 14 is displaceable along an axis A, which is defined by the drive-in channel 16 in the muzzle part 15, between an initial position (not shown in the drawings) and a press-on position 37 (FIGS. 1, 3, and 4). The press-on element 14 is resiliently biased in the direction of its initial position by a spring 22.

The drive-in tool 10 further includes a tensioning device generally designated with a reference numeral 70. The tensioning device 70 includes an electrically driven motor 71 that drives a threaded spindle 76. The threaded spindle 76 is rotatably supported in two bearings 77 in the housing 11 but without a possibility of an axial displacement therein. A control conductor 74 connects the motor 71 with the control unit 23. The motor 71 is actuated by the control unit 23 when, e.g., during a press-on process, a press-on element 14 actuates the press-on switch 29 or after completion of the drive-in process when the drive-in tool 10 is lifted again off the workpiece U. The motor 71 is so connected that it can rotate in both possible rotational directions. For rotating the threaded spindle 76 during operation of the motor 71, a transmission element 73 connects a driven wheel 72, which is supported on the output shaft of the motor 71, with a spindle wheel 75 of the threaded spindle 76. The transmission element 73 can be formed as belt, tooth belt, chain, cardan shaft, rod, or gear transmission. The axis of the output shaft of the motor 71 extends parallel to the rotational axis of the threaded spindle 76, and the motor 71 itself is located between two planes defined by opposite end surfaces of the threaded spindle 76. A sliding nut 78, which is formed as a ball nut and which engages with at least one ball the thread of the threaded spindle 76, is displaceable therealong. A second guide element 79 prevents rotation of the sliding nut 78 but does not interfere with the axial movement of the sliding nut 78 (see FIG. 2). Therefore, rotation of the threaded spindle 76 leads to an axial displacement of the sliding nut 78. During its movement in a direction opposite the drive-in direction 27, the sliding nut 78 is displaced against a stop 59 of the drive-in ram 13, which is formed as a projection, whereby the drive-in ram 13 is displaced together with the sliding nut 78. In this way, the drive-in ram 13 can be displaced to its setting- or drive-in ready position. Thereby, the driving spring 31 can be displaced from its release position 34 to its loaded position (shown in FIG. 3).

For retaining the drive-in ram 13 in its drive-in-ready position (see FIG. 3), there is provided a locking device generally designated with a reference numeral 50. The locking device 50 has a pawl 51 that engages, in its locking position 54, a locking surface 53 provided on a projection 58 of the drive-in ram 13, retaining the drive-in ram 13 against the biasing force of the driving spring 31. The pawl 51 is supported on a servo motor 52 and is displaceable to its release position 55, shown in FIG. 4, by the servo motor 52. The servo motor 52 is connected by an electrical control conductor 56 with the control unit 23 that transmits an adjusting command to the servo motor 52. The control conductor 56 forms a first control conductor, the second control conductor being the control conductor 74 that connects the motor 71 of the tensioning device 70 with the control unit 23.

When the drive-in tool 10 is pressed against a workpiece U, as shown in FIG. 1, the press-on element 14 and the electrical press-on switch 29 put the control unit 23 in a setting-ready position which transmits a switch-on command to the motor 71. Upon actuation of the motor 71, the driven wheel 72, the transmission element 73, and the spindle wheel 75 provide for rotation of the threaded spindle 76 in a rotational direction shown with a first arrow 80. Upon rotation of the threaded spindle 76 in the direction of the first arrow 80, the sliding nut 78 is axially displaced in a direction opposite the drive-in direction 27 from its first end position 83 (see FIGS. 3 and 4) at the muzzle-side of threaded spindle 76 to its second end position (see the dashed sliding nut 78 in FIG. 3). The sliding nut 78 engages the stop 59 of the drive-in ram 13, displacing it in the direction opposite the drive-in direction to its drive-in-ready position in which the pawl 51 of the locking device 50 automatically engages the locking surface 53 on the projection 58 of the drive-in ram 13. This leads to tensioning of the driving spring 31 that becomes displaced from its release position 34 (see FIG. 4) to its loaded position 33 (see FIG. 3).

As soon as the pawl 51 engages the locking surface 53 on the projection 58 of the drive-in ram 13, and the locking device 50 is in its locking position 54 (FIG. 3), a corresponding signal is transmitted to the control unit 23 that, in response to this signal, switches the motor 71 over in its second rotational direction. In response to the rotation of the motor 71 in its second rotational direction, the driven wheel 72, the transmission element 73, and the spindle wheel 75 provide for rotation of the threaded spindle 76 in a rotational direction shown with a first arrow 80. Upon rotation of the threaded spindle 76 in the direction of the first arrow 80, the sliding nut 78 is axially displaced in the drive-in direction 27 from its second end position 84 adjacent to the locking device 50 (see FIG. 3) to its first end position 83 at the muzzle-side end of the threaded spindle 76 (shown with solid lines in FIG. 3).

Upon actuation of the actuation switch 19 by the user, the control unit 23 displaces the locking device 50 in its release position 55 (see FIG. 4), in which the servo motor 52 pivots the pawl 51 in direction of a third arrow 83 away from the locking surface 53 of the projection 58 of the drive-in ram 13.

As a result of the lifting of the pawl 51 off the locking surface 53, the driving spring 31 drives the drive-in ram 13 in the drive-in direction 27, whereby the fastening element 60 is driven in the workpiece U with the drive in ram (13) (see FIG. 4). At the end of its drive-in path, the drive-in ram 13 is braked by a damping member 40 before the drive-in ram 13 can impact the sliding nut 78 so that the drive-in ram 13 would not damage the sliding nut 78. To this end, the damping member 40 is spaced from a first stop of the drive-in ram 13, which cooperates with the damping member 40, by an axial distance D1 which is smaller than an axial distance D2 by which the sliding nut 78 is spaced, in its first end position 83, from the stop 59 of the drive-in ram 13.

For displacing the drive-in ram 13 in its drive-in-ready position and for loading the driving spring 31, at the end of a drive-in process when the drive-in tool 10 is lifted off the workpiece U, or later when the drive-in tool 10 is pressed anew against the workpiece U, the tensioning device 70 is again actuated by the control unit 23, and the above-described process is repeated.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held drive-in tool for driving fastening elements (60) in a workpiece (U), comprising a housing (11); a guide (12) located in the housing (11); a drive-in ram (13) displaceable in the guide (12) for driving in the fastening elements; a spring (31) for driving the drive-in ram (13); a tensioning device (70) for loading the driving spring (31) and including a motor (71) and a threaded spindle (76) rotatable by the motor (71); a locking device (50) for retaining, in a locking position thereof (54), the driving spring (31) in a loaded position thereof (33); an actuation switch (19) for displacing the locking device (50) from the locking position (54) of the locking device (50) to a release position thereof (55) in which the driving spring (31) is displaced from the loaded position thereof (33) to a release position thereof (34) for driving the drive-in ram (13); and a sliding nut (78) supported on the threaded spindle (76) without a possibility of rotation thereabout but with a possibility of an axial displacement therealong, the sliding nut (78) being axially displaceable, upon actuation of the motor (71) of the tensioning device (70) by a control unit (23) of the drive-in tool (10), between a first end position (83) and a second end position (84), and being displaceable, during a loading cycle, from the first end position (83) to the second end position (84) for displacing the driving spring (31) into the loading position (33) of the driving spring (31), and being subsequently displaceable form the second end position thereof (84) in the first end position thereof (83) to provide for displacement of the driving spring (31) to a release position thereof.

2. A drive-in tool according to claim 1, wherein the sliding nut (78) is provided with at least one ball (78*a*) that serves as thread engagement means for engaging the threaded spindle (76).

3. A drive-in tool according to claim 1, further comprising a first control conductor (56) for connecting the locking device (50) with the control unit (23), and a second control conductor (74) for connecting the motor (71) of the tensioning device (70) with the control unit (23).

4. A drive-in tool according to claim 1, comprising a guide element (79) for retaining the sliding nut (78) against rotation.

5. A drive-in tool according to claim 1, further comprising at least one damping member (40) for braking movement of the drive-in ram (13) in a drive-in direction (27), the damping member (40) being spaced form a first stop of the drive-in ram (13), with which the damping member (40) cooperates, by an axial distance (D1) that is smaller than an axial distance (D2) by which the sliding nut (78) is spaced, in the first end position thereof (83), from a stop (59) of the drive-in ram (13) which is located opposite the sliding nut (13).

6. A drive-in tool according to claim 1, wherein an axis of an output shaft of the motor (71) of the tensioning device (70) extends parallel to a rotational axis of the threaded spindle, and the motor (71) is located between planes defined, respectively, by end surfaces of the threaded spindle.

* * * * *